United States Patent [19]

Nelson

[11] Patent Number: 4,674,599

[45] Date of Patent: Jun. 23, 1987

[54] HIGH RISE FIRE ESCAPE MECHANISM

[76] Inventor: Edward I. Nelson, 10430 NW. 24th St., Sunrise, Fla. 33322

[21] Appl. No.: 907,464

[22] Filed: Sep. 15, 1986

[51] Int. Cl.[4] ..... A62B 1/20

[52] U.S. Cl. ..... 182/231; 182/6; 182/236; 182/71

[58] Field of Search ..... 182/231, 236, 237, 71, 182/73, 232, 10, 5-7, 235, 240, 72; 188/65.1-65.3

[56] References Cited

U.S. PATENT DOCUMENTS

| | | | |
|---|---|---|---|
| 151,007 | 5/1874 | Bustin | 182/6 |
| 187,569 | 2/1877 | Tixier . | |
| 201,567 | 3/1878 | Stengel | 182/236 |
| 295,631 | 3/1884 | Gott | 182/237 |
| 456,003 | 7/1891 | Schneider | 182/236 |
| 491,405 | 2/1893 | Burgess | 182/231 |
| 636,486 | 11/1899 | Abbott | 182/231 |
| 654,705 | 7/1900 | Boody | 182/236 |
| 656,507 | 8/1900 | Brown | 182/236 |
| 657,641 | 9/1900 | Buddenbohn | 182/239 |
| 689,703 | 12/1901 | Brown | 182/236 |
| 708,546 | 9/1902 | Haggstrom . | |
| 794,834 | 7/1902 | Jones et al. . | |
| 4,470,480 | 9/1981 | Celez | 182/5 |

FOREIGN PATENT DOCUMENTS

| | | | |
|---|---|---|---|
| 321688 | 6/1902 | France | 182/236 |

*Primary Examiner*—Reinaldo P. Machado
*Assistant Examiner*—Alvin Chin-Shue
*Attorney, Agent, or Firm*—Oltman and Flynn

[57] ABSTRACT

A high rise fire escape mechanism uses a flat cable having notches to lower the victim. The cable is wound around a notched sprocket mounted inside a housing on a first axle. A second axle and an escapement mechanism mesh with the first axle to mechanically control the rate of descent of a victim to about four (4) feet per second.

9 Claims, 12 Drawing Figures

FIG. 6
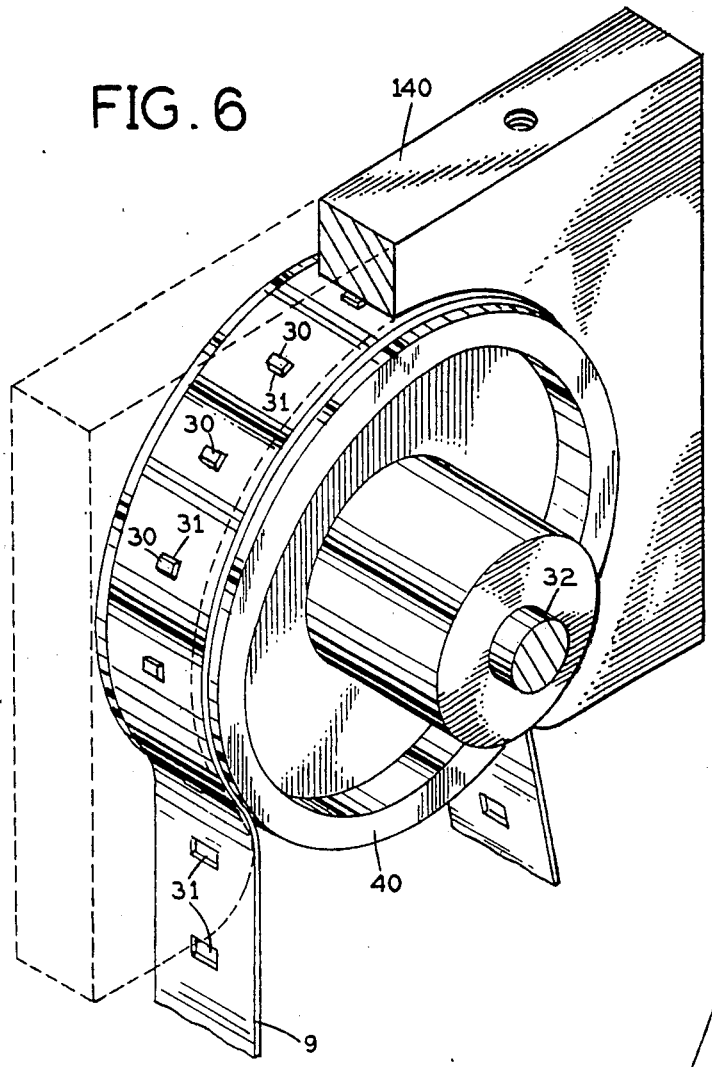
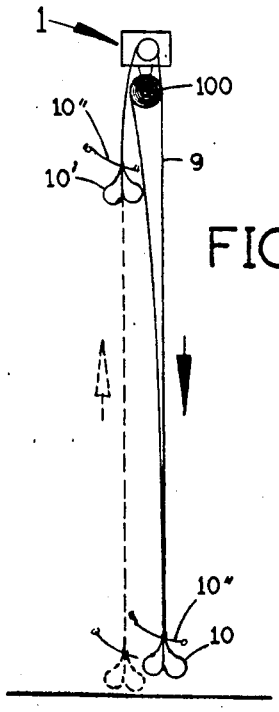
FIG. 8
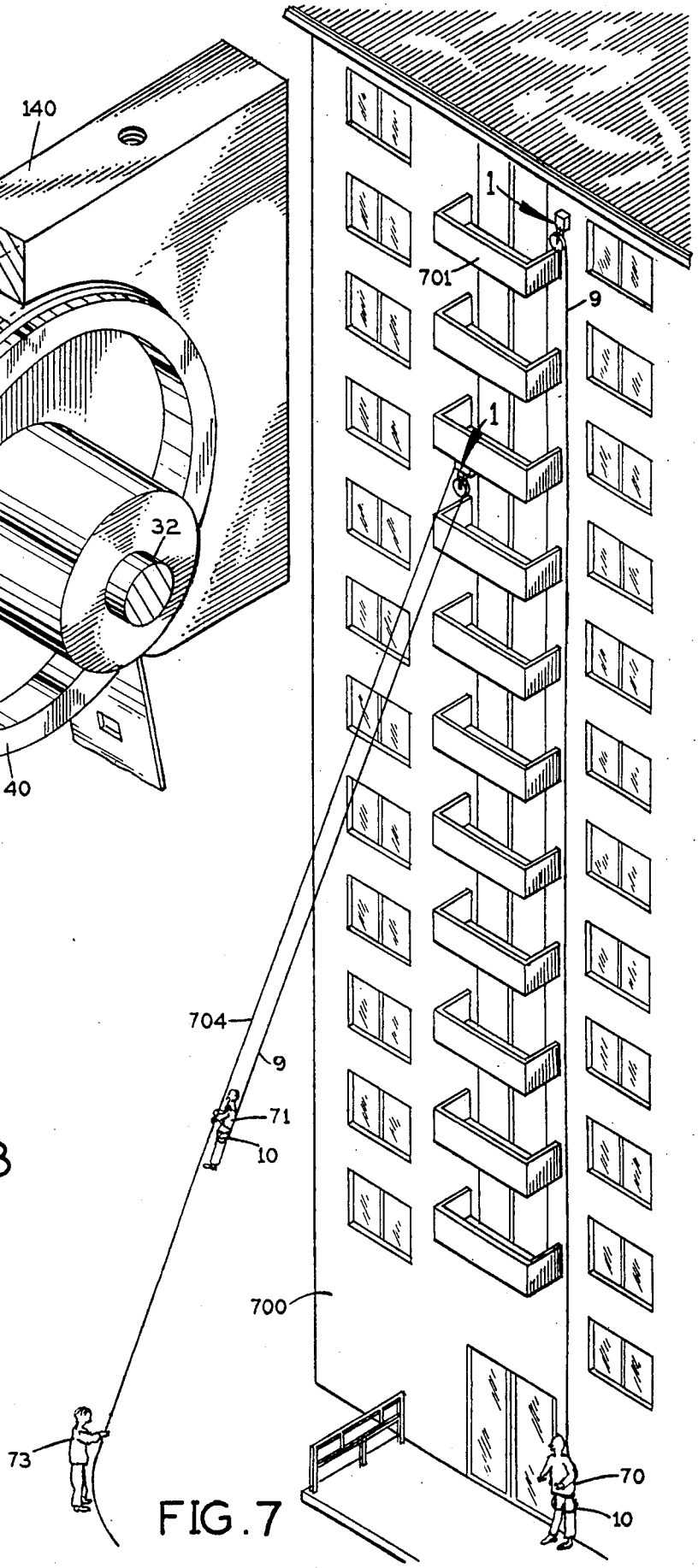
FIG. 7

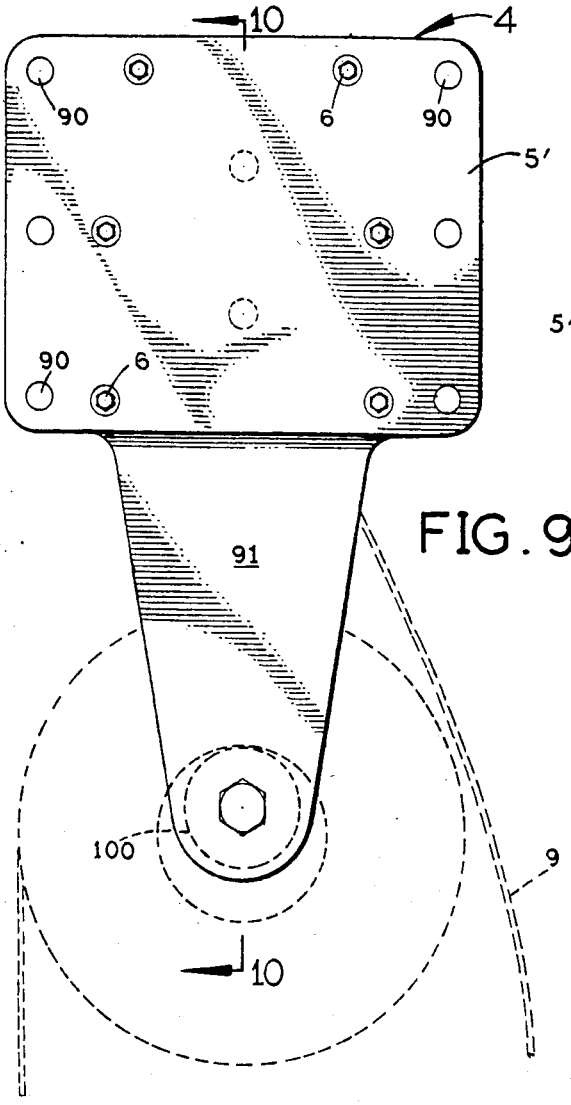
FIG. 9
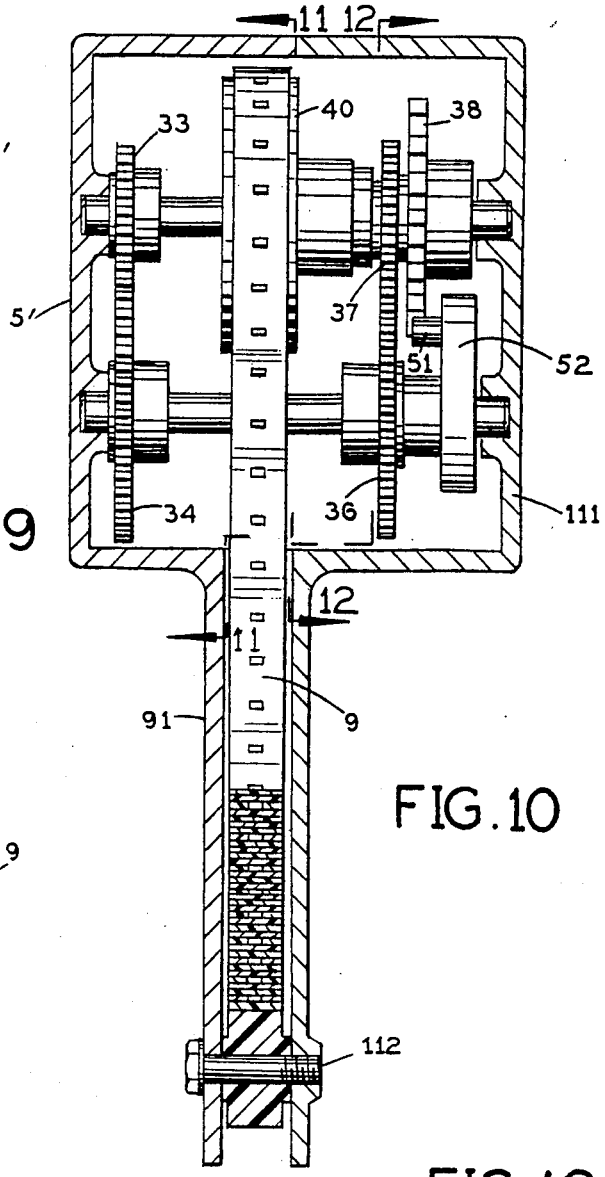
FIG. 10
FIG. 11
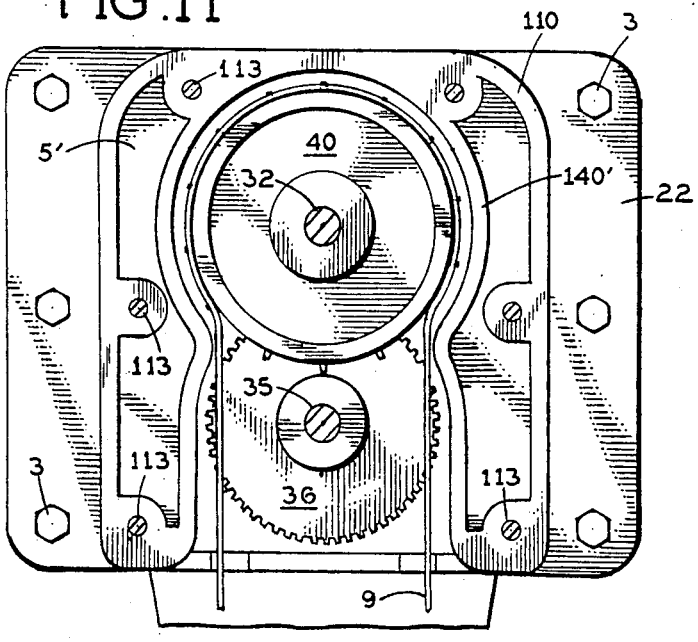
FIG. 12
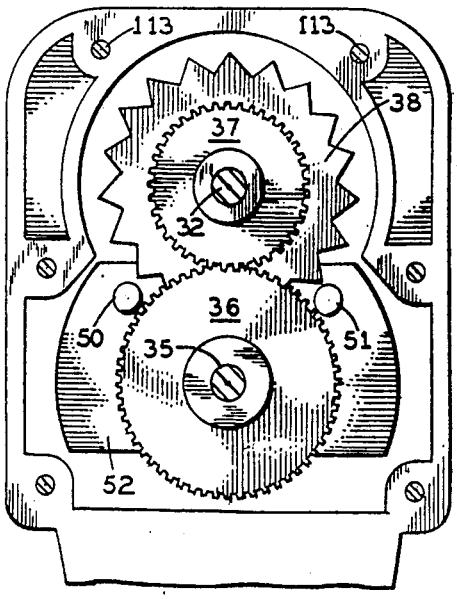

HIGH RISE FIRE ESCAPE MECHANISM

FIELD OF THE INVENTION

The present invention relates to a single cable emergency lowering system for use as a fire escape.

BACKGROUND OF THE INVENTION

A great deal of concern exists with residents of high rise buildings and fire departments all over the world about fires in those buildings. In the event of a fire, electricity is often turned off, cutting power to the elevators. Although enclosed stairways are usually available, the pathway to the stairs may be blocked by flames, the stairway may be filled with smoke and fumes, or the person may not be able to walk down ten or more flights of stairs.

Fire departments have acquired aerial ladders to reach higher floors but these are usually limited to ten stories or thereabouts. Above ten stories residents cannot obtain help from the fire department. Even when the local fire department has a ladder with sufficient reach, it takes a lot of time for each person to be evacuated, there may be many people to remove, and, therefore, it may take too long to rescue everyone.

The basic principle of a see-saw like single rope lowering device is well known. Applicant is not aware of any lowering device utilizing a flat slotted cable, a gear and a speed control or escapement mechanism.

Known frictional escape devices have problems. These are:

(a) Problems with weather changing the frictional characteristics;

(b) Frictional drag must be adjusted for the specific weight of the evacuee;

(c) A frictional device descends and is no longer available for a second person without hauling up cable; and (d) There is no guide rope to avoid building obstructions, etc.

SUMMARY OF THE INVENTION

The object of the present invention is to provide a simple and reliable mechanical lowering device which utilizes a flat cable and an escapement mechanism to maintain a constant speed of descent, regardless of weather conditions or the weight of the person descending.

Another object of the present invention is to provide a see-saw type lowering device wherein as one person reaches the ground, a second person can begin lowering himself without any need to rewind the cable.

Other objects of this invention will appear from the following description and appended claims, reference being had to the accompanying drawings forming a part of this specification wherein like reference characters designate corresponding parts in the several views.

The present invention consists of two main parts. The first is a flat cable made out of metal, or plastic coated metal, or out of plastic entirely. The flat cable will have holes punched in it at regular intervals to be engaged by teeth on a sprocket gear. The second part consists of a housing containing a mechanism which limits the rate of rotation of the sprocket gear to produce a controlled descent of approximately four (4) feet/second.

Also included in this invention is a means to crank the cable back up for re-use during another emergency and a case to enclose the working parts to keep them free of dirt and ready to use without maintenance or periodic service.

The high rise fire escape mechanism would be permanently installed on a balcony near a window or at any convenient exit point. Each end of the flat cable would contain a harness for a human. The length of the cable would be adjusted for each installation allowing approximately ten (10) feet of cable remaining when the other end is down on the ground. This ten foot length of cable allows the next person to don the harness and have capability to maneuver.

In operation, the first person would attach him- or herself to the cable using the harness. The person would then exit via the balcony or window and let go of any building support. The weight of the person will cause the cable to pay out at a controlled rate until he or she is safely down on the ground. Once on the ground the person would unfasten the harness and free the cable.

A second person would, upon seeing the cable stop moving, pull the remaining end of the cable free from the windup reel and fasten him- or herself into the harness at this second end. Then the person would follow the procedure as before. A third person would use the first side which would have been pulled back up by the descent of the second person.

In this way the device can be used over and over again until all the occupants have been safely evacuated from the building.

The mechanism to control the rate of descent utilizes a sprocket to engage the cable and prevent slippage with respect to the mechanism. Also attached to the same shaft as the sprocket is a gear which will engage another gear on a second shaft. Also included are additional gears and an escapement mechanism to govern the rate of rotation of the sprocket. The rate of descent is then controlled by the diameter of the sprocket wheel, the internal gear ratios and the period of the escapement mechanism. The rate of descent should be approximately four (4) feet/second. This rate allows the person to ward off projections from the side of the building (i.e. balconies, etc.) and is slow enough not to injure the person upon reaching the ground, yet rapid enough to evacuate someone quickly The harness consists of the flat cable being turned upon itself and fastened with screws and nuts or rivets via the sprocket holes, or may be a commercial fire rescue harness. The person would place one leg in each opening and the center strap would prevent anyone from falling through. The belt portion of the harness prevents someone from falling out backwards and frees the hands for avoiding projections.

BRIEF DESCRIPTION OF THE DRAWINGS

FIG. 6 is a fragmentary view of the device shown in FIGS. 1 through 5 showing the flat cable and main sprocket gear.

FIG. 7 shows the preferred use of the high rise fire escape wherein a guide line serves to keep the victim away from the building and prevents him from hitting protrusions from the building on his descent, or to avoid obstacles such as trees, fences or cars on the ground.

FIG. 8 shows an optional way to thread the high rise fire escape mechanism wherein one detachable harness is mounted at intermediate points along the length of the flat cable allowing see-saw use of the device without requiring fixed length cables. It is of use to emergency rescue personnel.

FIG. 9 shows a rear elevational view of the device shown in FIG. 1.

FIG. 10 shows a sectional view of the device shown in FIG. 9 taken along line 10—10.

FIG. 11 shows an optional embodiment of the high rise fire escape mechanism taken along line 11—11 of FIG. 10 having a solid casting for an outer case.

FIG. 12 shows the solid casting embodiment taken along line 12—12 of FIG. 10.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Figures 1, 2:
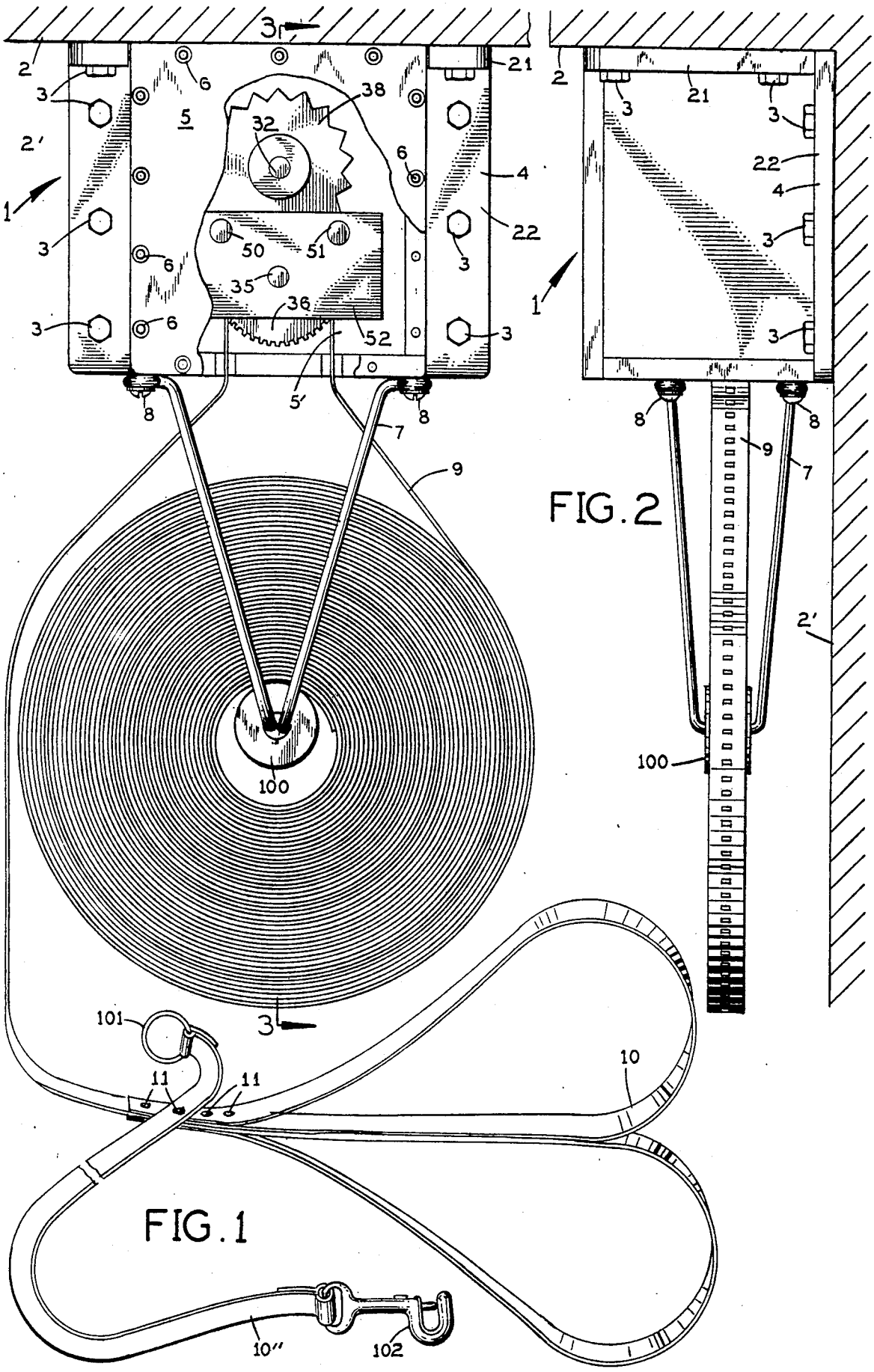
FIG. 1 shows a front elevational view with a partial cutaway of the high rise fire escape mechanism.
FIG. 2 shows a left side elevational view of the high rise fire escape mechanism.

Referring first to FIG. 1, the high rise fire escape mechanism 1 is securely mounted to vertical wall 2' and/or horizontal wall 2 by means of bolts 3. Housing 4 is of sturdy construction and preferably built to withstand the outside elements. Removable side plate 5 is secured to housing 4 by means of screws 6 which in this embodiment have Allen wrench heads or other tamperproof fasteners to prevent tampering.

Cable bracket 7 is secured to housing 4 by means of screws 8. Cable 9 is wound around reel 100 at one end, then threaded over sprocket 40 (see FIG. 4) before descending downward with safety harness 10 at the opposite end. Safety harness 10 is shown in this embodiment as a simple loop back of cable 9 plus an extra loop of cable, all fastened by rivets 11. A harness portion 10" fastens around the waist of the user. The latch 102 fastens to the ring 101.

FIG. 2 shows the rectangular box shape of the high rise fire escape mechanasim 1. Housing 4 has mounting flanges 21 and 22.

Figure 3:
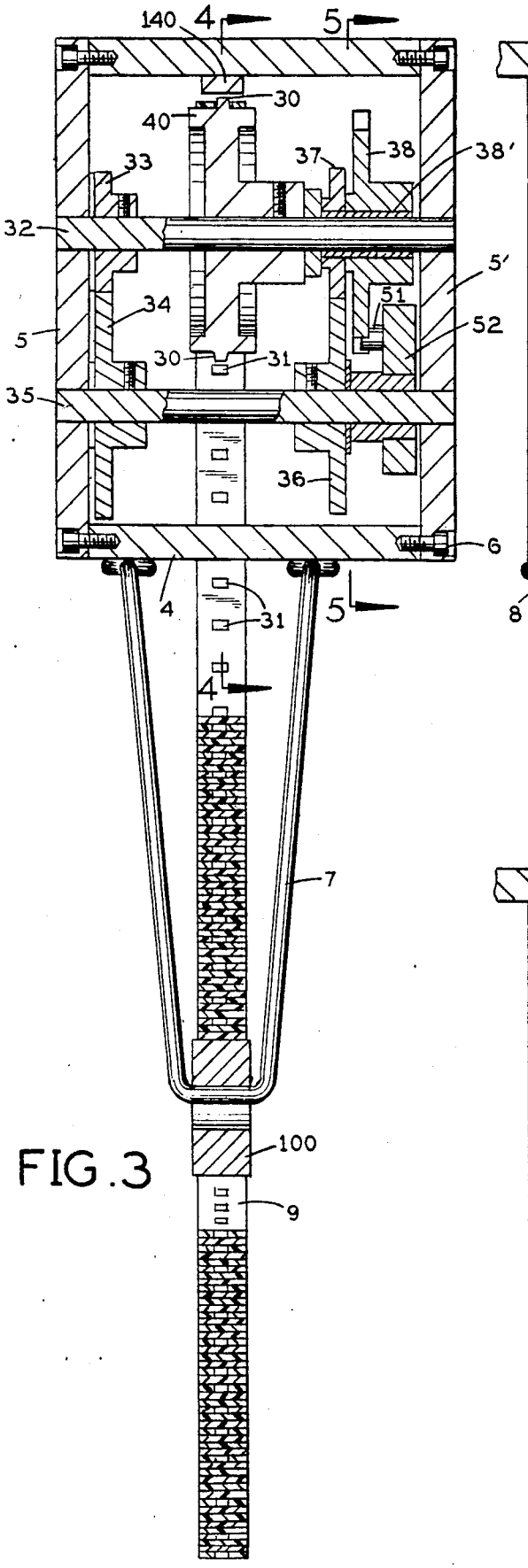
FIG. 3 is a sectional view of the device shown in FIG. 1 taken along line 3—3.

FIG. 3 shows cable 9 wrapped around sprocket 40. Cable 9 has notches 31 which mesh with teeth 30 of sprocket 40. Sprocket 40 is nonrotatably affixed to axle 32 which is rotatably mounted in sideplates 5 and 5' of housing 4. Axle 32 has gear 33 also nonrotatably permanently affixed thereto. Gear 33 meshes with gear 34 which is permanently nonrotatably affixed to parallel axle 35. In operation axle 32 is rotated by the force of cable 9 pulling downward due to the weight of the person descending. Gear 33 drives gear 34 and parallel axle 35.

Figure 5:
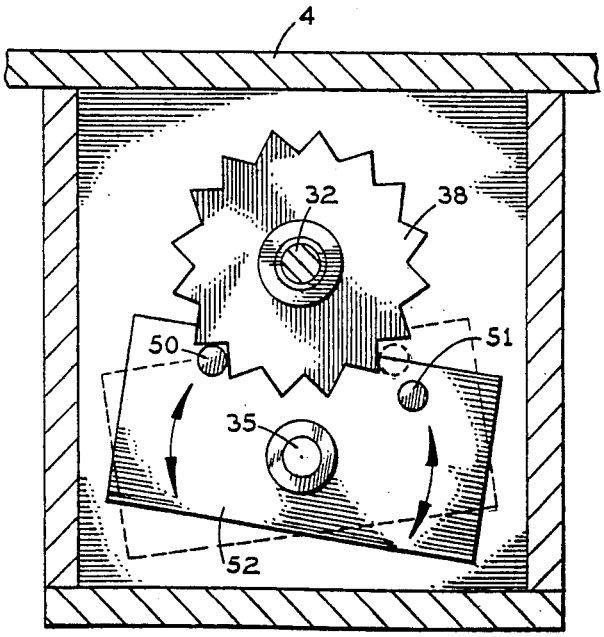
FIG. 5 is a sectional view of the device shown in FIG. 3 taken along line 5—5.

At the same time gear 36, which is non-rotatably affixed to parallel axle 35, is meshing with gear 37. Gear 37 is permanently affixed to star ratchet gear 38. Gears 37 and 38 are non-rotatably mounted on sleeve 38' which is rotatably mounted on axle 32. Star ratchet gear 38 acts as a braking force to gears 37, 36, 34 and 33 and therefore to both axles 35 and 32. The braking action is caused by the brake studs 50 and 51 which are permanently affixed to escapement plate 52 (See FIG. 5). The position of the mating gears relative to the sprocket is not critical and gears 33 and 34 may be mounted to the right of the sprocket 40.

Escapement plate 52 is rotatably mounted to axle 35. As can best be seen in FIG. 5, escapement plate 52 rapidly oscillates back and forth as driven by star ratchet gear 38 upon brake studs 50 and 51 alternately slipping off and engaging over star ratchet gear 38. The braking action caused by the escapement plate oscillations controls the rate of descent of cable 9 when supporting a human to an approximate descent rate of four (4) feet per second.

Figure 4:
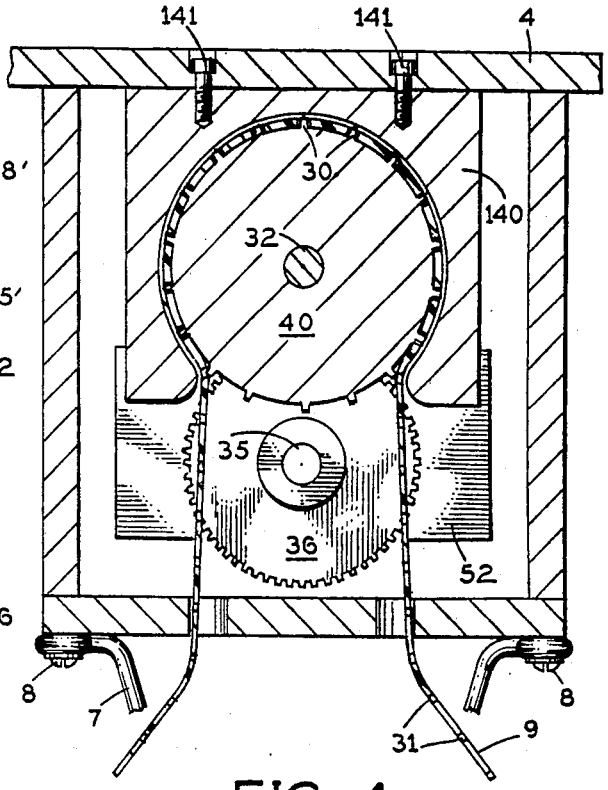
FIG. 4 is a sectional view of the device shown in FIG. 3 taken along line 4—4.

FIG. 4 shows how plate 140 forces cable 9 to stay meshed with teeth 30 on sprocket 40 during descent. Screws 141 hold plate 140 firmly in place. FIG. 6 shows an enlargement of the same detail.

FIG. 7 shows two separate methods of use of high rise fire escape mechanism 1. Victim 70 has used the high rise fire escape mechanism in the alternate method of lowering himself straight down the side of building 700. Victim 70 has merely stepped off balcony 701 wearing harness 10. Victim 70 held onto cable 9 and descended to sidewalk 702 at the rate of approximately four (4) feet per second. At this time victim 70 could step out of harness 10 and a second victim (not shown) could step into a second harness (not shown) at the upper end of cable 9 and descend down the side of building 700.

Victim 71, using the preferred method, has hooked the belt of the harness over the guide line 704 which is held by fireman 73. This method allows victim 71 to land away from the burning building 700, avoiding the protruding balconies or flames on the way down.

FIG. 8 shows an optional embodiment of high rise fire escape mechanism 1 wherein a second detachable harness 10' is mounted at an intermediate point along cable 9 thereby allowing a complete see-saw type usage of harnesses 10 and 10' at any height within the length of the cable.

FIG. 9 shows how the screws 6 lie flush with backplate 5' and hold housing 4 together. Bolts 3 mount through holes 90 (see FIG. 2). This embodiment uses a continuation of housing 4, seen as 91, to serve as the reel 100 supporter.

FIGS. 9, 10, 11 and 12 show the solid casting embodiment of housing 4 utilizing the reel supporter 91. A cable protector 140' is built into housing 4 as a single casting. Casting walls 110 are integral to backplate 5'. A two piece casting is shown. Front plate 111 mounts atop backplate 5' and is held on by bolt 112 and screws 6 which fit in holes 113. All other working parts are the same as FIGS. 1 through 8.

The high rise fire escape mechanism shown in FIGS. 1 through 12 can be used for helicopter evacuation as well, such as for the rapid deplaning of troops into combat areas.

It can be used in apartment buildings, hotels, office buildings and hospitals to speed evacuations. Extra harnesses can be fastened onto the cable. Using attachments, it would be possible to lower a bed or a cage or the like. It would even be possible to have multiple steps on the cable to allow continuous evacuation of a building.

I claim:

1. A descent control device to be affixed to a structure, comprising:

a housing having mounting means for affixation to said structure;

a flat notched descent cable;

a cable sprocket having teeth meshing with said flat notched descent cable;

a first axle rotatably mounted inside said housing;

said cable sprocket affixedly mounted to said first axle;

a second axle parallel to said first axle and mounted inside said housing; and an escapement mechanism comprising said first and second axles, an oscillating escapement plate, brake teeth, and gears, wherein said flat notched descent cable descends while under load at a slow controlled rate by means of a braking action imparted by said escapement mechanism;

said escapement mechanism further comprising:

a first gear affixedly mounted on said first axle;

a second gear affixedly mounted on said second axle and meshing with said first gear;

a third gear affixedly mounted to said second axle;

a fourth gear rotatably mounted to said first axle and meshing with said third gear;

a star ratchet gear having teeth rotatably mounted to said first axle and affixed to said fourth gear;

an oscillating escapement plate rotatably mounted to said second axle;

said oscillating escapement plate having at least two brake teeth;

said brake teeth meshing with said star ratchet gear to oscillate, and thereby allow one gear tooth at a time of said star ratchet gear to advance, thereby creating a braking action for said cable.

2. The descent control device of claim 1, wherein said cable has a harness at one end.

3. The descent control device of claim 1, wherein said cable has a length at least ten feet longer than the height of said descent control device above the ground.

4. The descent control device of claim 1, wherein said housing further comprises a cable sprocket protector plate functioning to prevent said cable from slipping off said cable sprocket during descent.

5. The descent control device of claim 1 in combination with a guide line to be strung from the structure to the ground for guiding the path of descent.

6. The descent control device of claim 1 further comprising a cable reel and means for mounting said cable reel to said housing.

7. The descent control device of claim 6 wherein said cable before use is rolled around said reel.

8. The descent control device of claim 6, wherein said cable has a harness at one end and a second detachable harness at an intermediate position along the cable length allowing full see-saw threading around said cable sprocket without unraveling said second end of said cable from said reel to begin second descent.

9. A descent control device to be affixed to a structure, comprising:

A housing having mounting means for affixation to said structure;

a flat notched descent cable;

a cable sprocket having teeth meshing with said flat notched descent cable;

a first axle rotatably mounted inside said housing;

said cable sprocket affixedly mounted to said first axle;

a second axle parallel to said first axle and mounted inside said housing; and an escapement mechanism comprising said first and second axles, an oscillating escapement plate, brake teeth, and gears, wherein said flat notched descent cable descends while under load at approximately four (4) feet per second by means of a braking action imparted by said escapement mechanism;

said escapement mechanism further comprising:

a first gear affixedly mounted on said first axle;

a second gear affixedly mounted on said second axle and meshing with said first gear;

a third gear affixedly mounted to said second axle;

a fourth gear rotatably mounted to said first axle and meshing with said third gear;

a star ratchet gear having teeth rotatably mounted to said first axle and affixed to said fourth gear;

an oscillating escapement plate rotatably mounted to said second axle;

said oscillating escapement plate having at least two brake teeth;

said brake teeth meshing with said star ratchet gear to oscillate, and thereby allow one gear tooth at a time of said star ratchet gear to advance, thereby creating a braking action for said cable.

* * * * *